United States Patent [19]

Schaefer

[11] Patent Number: 4,964,891

[45] Date of Patent: Oct. 23, 1990

[54] PROGRAMMABLY CONTROLLED FIBER GLASS STRAND FEEDERS AND IMPROVED METHODS FOR MAKING GLASS FIBER MATS

[75] Inventor: William L. Schaefer, Butler, Pa.

[73] Assignee: PPG Industries, Inc., Pittsburgh, Pa.

[21] Appl. No.: 435,903

[22] Filed: Nov. 13, 1988

[51] Int. Cl.[5] ..... C038 37/07

[52] U.S. Cl. ..... 65/4.4; 65/9; 65/29; 65/160; 156/62.4; 156/62.6

[58] Field of Search ..... 65/4.4, 9, 29, 160; 156/62.4, 62.6

[56] References Cited

U.S. PATENT DOCUMENTS

| | | | |
|---|---|---|---|
| 3,265,482 | 8/1966 | Langlois et al. | 65/9 |
| 3,713,962 | 1/1973 | Ackley | 161/154 |
| 3,814,592 | 6/1974 | McWilliams et al. | 65/3 |
| 3,849,148 | 11/1974 | Temple | 106/287 |
| 3,883,333 | 5/1975 | Ackley | 65/2 |
| 3,915,681 | 10/1975 | Ackley | 65/9 |
| 4,148,958 | 4/1979 | Tischer et al. | 428/196 |
| 4,158,557 | 6/1979 | Drummond | 65/2 |
| 4,277,531 | 7/1981 | Picone | 428/228 |
| 4,335,176 | 6/1982 | Baumann | 428/228 |
| 4,340,406 | 7/1982 | Neubauer et al. | 65/9 |
| 4,342,581 | 8/1982 | Neubauer et al. | 65/4.4 |
| 4,345,927 | 8/1982 | Picone | 65/4.4 |
| 4,404,717 | 9/1983 | Neubauer et al. | 28/107 |
| 4,604,319 | 8/1986 | Evans et al. | 428/290 |
| 4,615,717 | 10/1986 | Neubauer et al. | 65/4.4 |
| 4,749,613 | 6/1988 | Yamada et al. | 428/286 |
| 4,755,423 | 7/1988 | Greiser et al. | 428/284 |

OTHER PUBLICATIONS

U.S. Patent Application Ser. No. 07/418,005 (Schaefer, et al.), filed Oct. 6, 1989.

U.S. Patent Application Ser. No. 07,418,058 (Bailey et al.), filed Oct. 6, 1989.

"Ein Kunststoff fur hochbeanspruchte Teile", *Industrie, Nr. 53, vol. 4.7 (1984), pp. 3–7 (with English translation entitled Plastics Technology).*

"Gould 3220 Flexible Automation Controller", Gould Electronics.

"Axis Profiling Using the DNPII Axis Card", Gould Electronics.

"Software Specification for PPG Industries, Inc., Fiber Glass Research Division, Matline Machine", MODICON-ICC, Pittsburgh, PA.

"The Manufacturing Technology of Continuous Glass Fibers", K. L. Lowenstein, Elsevier Publishing Company, 1973, pp. 234–251, 97–106 and 25.

*Primary Examiner*—Robert L. Lindsay

*Attorney, Agent, or Firm*—Richard E. Maebius

[57] ABSTRACT

The specification of the instant invention discloses improvements in methods for making various types of mats of fiberous material. In particular, the improvements relate to methods for making continuous fiber glass strand mats using reciprocating strand feeders and a programmable motion controller to control both the rate of reciprocation and the rate at which strand is deposited from the feeders onto a moving conveyor so as to form mats of uniform density and thickness. Electric servomotors are used to reciprocate the feeders and also deposit strand therefrom. A closed-loop feedback circuit is used to accurately monitor and control the position of the feeders with respect to the conveyor as well as the rate of strand deposition. Methods for using the programmable motion controller described herein can increase the uniformity of needled, resin-impregnated, and uni-directional fiber glass mats.

21 Claims, 7 Drawing Sheets

PROGRAMMABLY CONTROLLED FIBER GLASS STRAND FEEDERS AND IMPROVED METHODS FOR MAKING GLASS FIBER MATS

The instant invention relates to improvements in methods for making mats of fiberous material. More particularly, the invention relates to methods for making continuous strand mats using reciprocating strand feeders and a programmable motion controller to control both the rate of reciprocation and the rate at which strand is deposited from the feeders onto a moving conveyor so as to form mats of uniform density and thickness. Still more particularly, the invention relates to methods for the production of continuous fiber glass strand mats having improved uniformity and mechanical properties using programmably controlled reciprocating feeders.

BACKGROUND OF THE INVENTION

Glass fibers and glass fiber strands have been used before in the art to produce various types of glass fiber mats for use as reinforcement material. The basic principles of mat-making are well known in the art and are fully described in the book entitled "The Manufacturing Technology of Continuous Glass Fibers" by K. L. Lowenstein, published by the Elsevier Publishing Company, 1973 at pages 234 to 251. Typical processes for making mats of continuous fiber glass strands are also described in U.S. Pat. Nos. 3,883,333 (Ackley) and 4,158,557 (Drummond).

Generally, mats formed by these processes are needled in order to improve their mechanical integrity. The needling operation typically used is described more fully in U.S. Pat. Nos. 3,713,962 (Ackley), 4,277,531 (Picone) and 4,404,717 (Neubauer, et al.) Mechanical integrity can also be imparted to mats by depositing a resin on its surface and then curing or melting it so that individual strands are bonded together.

A particular utility for glass fiber mats is in the reinforcement of resinous or polymeric materials. The presence of an integrally molded glass fiber mat increases the strength of otherwise unreinforced material. Usually, the mat and a molten resin are processed together to form a thermosetting or thermoplastic laminate. Thermoplastic laminates are particularly attractive for use in the aircraft, marine, and automotive industries since they may be reheated into a semi-molten state and then stamped into panels of various shapes such as doors, fenders, bumpers, and the like. It is important that glass mats used to make laminates have as uniform a fiber density distribution as possible. If a non-uniform density mat is used for reinforcement purposes, the reinforced products produced therefrom may have a substantial variation in strength since some areas will be weaker due to the lack of glass fiber reinforcement while others will be stronger. Even more important is the need to insure that the glass fiber mat flows or moves freely within a thermoplastic laminate during the stamping operation in order to provide uniform strength properties to the final component.

In the production of continuous strand mats by the aforementioned patented processes, a plurality of strand feeders are positioned above a moving belt or conveyor, typically a continuously driven, flexible, stainless steel chain or cable. The strand feeders are reciprocated or traversed back and forth above the conveyor parallel to one another and in a direction generally perpendicular to the direction of motion of the moving conveyor. Strands composed of multiple glass fiber filaments are fed to the feeders from a suitable supply source such as a plurality of previously made forming packages. Each feeder apparatus provides the pulling force necessary to advance the strand from the supply source and eventually deposit it upon the surface of the moving conveyor. In a typical production environment, as many as 12 to 16 such strand feeders have been used simultaneously with one another so as to produce a glass fiber mat.

It is also well known in the art that the feeder can act as an attenuator to attenuate glass fibers directly from a glass fiber-forming bushing and eventually deposits strand formed therefrom directly onto the conveyor as described by Lowenstein, supra at pages 248 to 251 and further illustrated in U.S. Pat. Nos. 3,883,333 (Ackley) and 4,158,557 (Drummond).

In the operation of the traversing system described above, the configuration of the equipment used suffers from inherent limitations on its mechanical durability. First, the feeders are quite heavy, usually weighing between 30 and 50 pounds or more. When this heavy apparatus is reciprocated across the width of the conveyor, the traverse speed is limited due to the momentum of the moving feeder and the impact forces which must somehow be overcome or absorbed upon each reversal of direction. This mechanical limitation on the traverse speed also limits the rate of mat production. Secondly, the constant reciprocating motion of the feeders causes vibration to occur and this can result in a great deal of wear on the feeder mechanisms and their track guides, which may eventually lead to mechanical failure.

In U.S. Pat. 3,915,681 (Ackley), a reduction in the vibration normally associated with the reversal of a feeder was accomplished by the use of a traversing system in which a feeder was advanced by a continuous chain driven by a motor. The chain had affixed to it an extended member, or pin, which engaged a slot milled into the feeder carriage. The slot was positioned so that its length was parallel to the direction of motion of the chain. The length of the slot was substantially greater than the diameter of the pin. Thus, as the feeder traveled in one direction, the pin exerted the force necessary to advance it by pressing against the periphery of the slot. When the feeder reversed its direction, the pin first slid along the length of the slot until it contacted the opposite periphery at which point the motion of the feeder was reversed. At the termination point of the reciprocation stroke, the feeder contacted a shock absorber which decelerated it and absorbed the impact due to the change in momentum. Later, as an improvement on this design, the shock absorbers were replaced with gas pistons and a reservoir capable of storing the absorbed energy was used to help accelerate the feeder in the opposite direction (See U.S. Pat. No. 4,340,406 (Neubauer, et al.)).

A second problem with the systems taught by the prior art was the ability to produce a consistent mat of uniform strand density. In the deceleration/acceleration cycle of the feeders, more glass strands tended to accumulate on the conveyor at the terminal end of each traverse stroke. This resulted in a mat tending to be thicker near its edges than in the more central portions thereof. The buildup of additional glass strands near the edges of the mat was caused when the feeder reversed its direction since the feeder was locally resident for a greater duration of time over those portions of the mat where the deceleration/acceleration cycle occurred, i.e., the edges. As long as the feeder was paying out strand at a constant rate during the turnaround cycle, the edges of the mat could do nothing but accumulate a greater depth of glass strand than was present in the more central regions. Thus, in order to produce a finished mat having a uniform density, it was necessary to trim the mat as it left the conveyor. This reduced the efficiency of the process by a substantial amount since the trimmed material was disposed of as waste.

Thus, despite the advances made by the prior art, there still exists a need to (1) rapidly reverse the feeder apparatus during its turnaround cycle, (2) minimize the mechanical vibration associated with a rapid turnaround of the feeder apparatus, and (3) control mat edge uniformity and density. As will now become evident from the remainder of the disclosure, an improved mat-making method is provided which satisfies these needs.

SUMMARY OF THE INVENTION

In accordance with the instant invention, an improvement in methods for making continuous fiber glass strand mats using programmably controlled strand feeders is disclosed. In particular, the instant invention employs the use of conventional reciprocating strand feeders adapted so that both the rate of reciprocation and the rate at which strands are deposited from the feeders onto a moving conveyor can be accurately controlled by the use of a programmable motion controller to produce mats having more uniform strand density and thickness distributions. Strand may be supplied to the feeders from either previously made fiber glass forming packages, roving bundles, direct-draw roving packages, or from marble-melt or direct-draw fiber glass bushing assemblies.

It is an object of the instant invention to minimize the mechanical vibration associated with a rapid turnaround of the feeder apparatus. It is a further object to better control the overall uniformity of mat density and thickness across the surface of the mat. It is still a further object of the instant invention to utilize the programmable feeders as disclosed herein to eliminate or reduce edge non-uniformity.

These objectives have been achieved by the use of a programmable motion controller to accurately move, monitor, and control the operation of brushless servomotors to reciprocate the feeders and rapidly reverse their direction. Also, the programmable motion controller is used to control a second brushless servomotor to optimize the rate at which strand is deposited from each feeder onto the surface of the moving conveyor as a pre-programmed function of the position of the feeder with respect to the width of the conveyor.

DETAILED DESCRIPTION OF THE DRAWINGS

Figure 2:
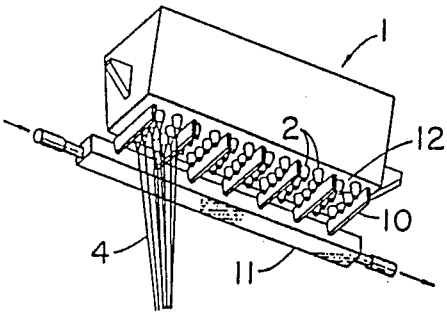
FIG. 2 (PRIOR ART)
FIG. 2 is a perspective view of a bushing, its associated fin coolers, individual tips, and fibers emerging therefrom.
Figure 1:
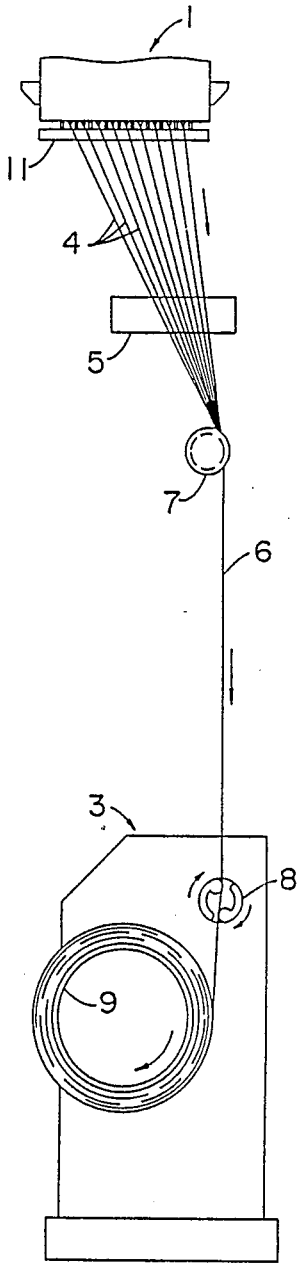
FIG. 1 (PRIOR ART)
FIG. 1 is a side elevational view of a conventional fiber glass forming process showing a bushing, an applicator, and a winder.

With reference to the drawings, FIGS. 1 and 2 illustrate a conventional process for the production of glass fibers wherein molten glass is fed into the top of a bushing assembly (1) and exits from a plurality of tips or orifices (2) to form individual glass cones or jets which are then cooled and attenuated. The glass may be supplied from a direct-melt forehearth or, glass marbles may be melted directly inside the bushing. Both of these methods are well known in the art and fully described in Lowenstein, supra at pages 97–106. The drawing force for the attenuation of the cone or jet into an individual glass filament may be supplied by either an appropriately powered rotating winder (3), or a reciprocating belt attenuator that grips the glass fibers and projects them onto the surface of a continuous conveyor as disclosed in U.S. Pat. Nos. 3,883,333 (Ackley) and 4,158,557 (Drummond).

The individual glass fibers or filaments (4) (hereinafter referred to simply as "fibers"), once they have been sufficiently cooled so as to substantially solidify, are contacted with a roller applicator (5) which coats them with a liquid chemical sizing composition. The sizing composition helps to impart lubricity to the individual fibers and also usually contains a binder which provides a bonding agent. The chemical characteristics of the sizing composition and binder are such that they are compatible with the intended end-use of the glass fibers. For example, when a resin such as a thermoplastic is to be reinforced with glass fibers, then the binder and/or size normally will also include a compatible thermoplastic resin. On the other hand, when the material to be reinforced is a thermoset resin, the binder and/or size will normally include a compatible thermosetting resin.

Resins such as polyesters, polyurethanes, epoxies, polyamides, polyethylenes, polypropylenes, polyvinyl acetates, and the like have been reinforced with glass fibers. Notable resins which are typically reinforced with continuous glass strand mats are polypropylene, polyesters, and nylon. A preferred binder/size composition for glass fibers intended to be used for the reinforcement of polypropylene is disclosed in U.S. Pat. No. 3,849,148 (Temple). When continuous glass strand mat is used to reinforce a nylon resin, a preferred binder/size composition is that which is disclosed in U.S. Pat. No. 3,814,592 (McWilliams, et al.).

The fibers (4) drawn from the bushing (1) are gathered into single or multiple strands (6) by passing a plurality of individual fibers (4) over a gathering shoe (7). The gathering shoe (7) is typically a graphite cylinder or disc having cut therein a plurality of grooves cut about its circumference. The number of grooves is equal to the number of individual strands to be formed from a single bushing. Strand (6) is then wound over a rotating spiral (8) and onto a cardboard forming tube (9) which is rotated by an appropriately powered winder (3). The winder (3) may cause either the forming tube (9), spiral (8), or both to reciprocate back and forth along their axis of rotation so that the strand (6) passing over the spiral (8) is wound evenly along the length of the forming tube (9). Cooling fins (10) are inserted between adjacent rows of tips (2) with one end of each fin being attached to a manifold (11) through which a cooling fluid, such as water, is pumped. The fins (10) are positioned so as to absorb radiative heat from the individual glass cones and conduct it to the manifold (11) where it is removed by the cooling fluid. The fins also remove some heat radiated by the tip plate (12).

Figure 3:
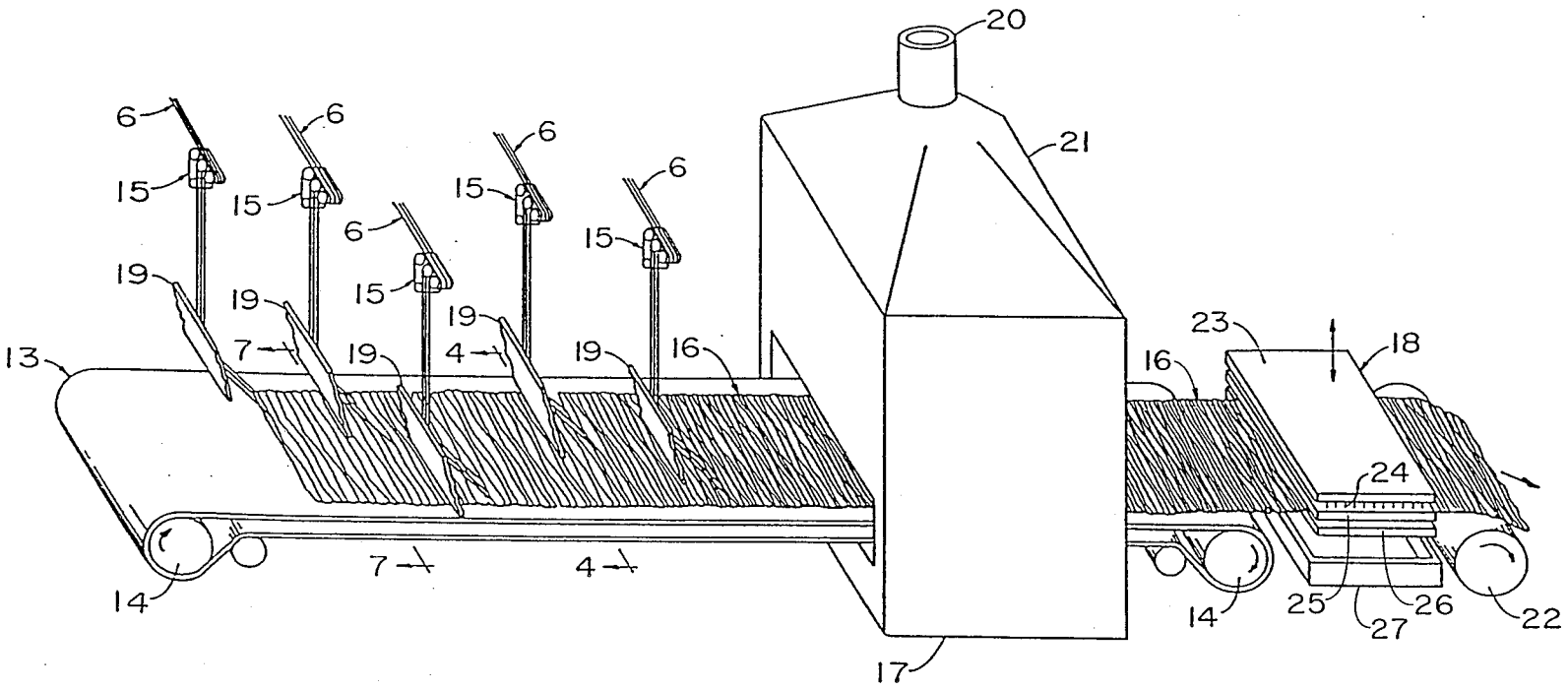
FIG. 3 is a perspective view of a typical mat line used to produce a needled continuous strand mat.

FIG. 3 depicts a conveyor (13) which is in the form of an endless perforated belt, preferably a stainless steel chain, continuously driven by an electric motor (not shown) and spaced drive rollers (14). In commercial applications, conveyor speeds of up to 12 ft/min or greater have been used. Strands (6) are shown being projected downwardly onto the surface of the conveyor by means of a plurality of reciprocating strand feeders (15). (While only five such strand feeders are shown in the drawing, this is for illustrative purposes only, and the actual number used can be either greater or lesser. In fact, in commercial applications, as many as 12 individual strand feeders have been used simultaneously to lay strand onto the conveyor (13).)

As is indicated in FIG. 3, each feeder (15) is traversed across a pre-determined width of the conveyor (13) while strand is deposited. Individual strands (6) may be drawn from a supply source such as a plurality of previously made forming packages or from direct-draw or marble-melt glass fiber bushings in the manner illustrated in U.S. Pat. Nos. 3,883,333 (Ackley) and 4,158,557 (Drummond).

In the prior art, strand (6) was deposited from each feeder apparatus (15) directly onto the moving conveyor. While this technique produced an acceptable mat, it was later found that the strand so deposited often tended to assume a preferred orientation. To overcome this, the use of deflector plates rigidly attached to each feeder apparatus in such a fashion that the strand would impinge upon them and be deflected randomly onto the conveyor was adopted. This produced a mat having more uniform strength (See U.S. Pat. No. 4,345,927 (Picone)). Another type of rigidly attached deflector such as that disclosed in U.S. Pat. No. 4,615,717 (Neubauer, et al.) was later developed to divide the strand, as it was ejected by the feeder, into a plurality of filamentary arrays that would be deflected and deposited onto the surface of the conveyor in the form of elongated elliptical loops. More recently, it has been shown in U.S. patent application Ser. No. 07/418,005 (Schaefer, et al.) that the use of adjustable stationary deflectors (19) attached to the frame of the mat-making apparatus resulted in an improvement over the prior art while also reducing the momentum associated with the reciprocating feeders (15).

To remove any excess moisture from the strand, the mat is continuously passed through an oven (17). The oven (17) is connected to a duct (20) and provided with a heater (not shown) to heat a gas passed through it. The heated gas, preferably air heated to between 70° F. and 140° F., is passed through the hood (21) of the oven (17). The oven (17) completely covers the width of the conveyor (13) and extends a sufficient distance along its length to produce a residence time sufficient to reduce the moisture content of the mat to an acceptable level, usually between 1 and 0.5 percent.

After emerging from the oven (17), the loose mat (16) is usually advanced from the surface of the conveyor (13) to a needling loom (18). The mat is pulled through the loom by means of a drive roller (22) which may move at a speed slightly greater than that of the conveyor. The loom (18) has a needle board (23) to which are affixed a plurality of barbed needles (24) typically arranged in rows parallel to one another. The loom (18) includes a stripper plate (25) having a plurality of holes drilled through it so that the needles (24) can be readily reciprocated therethrough. A bed plate (26), on which the mat (16) rests as it passes through the loom (18), is provided which also has a plurality of appropriately sized holes so that the reciprocating needles may pass through them. A tray (27) is provided to catch any broken glass filaments. The needle board (23) reciprocates up and down as depicted by the arrows in FIG. 3 so as to push the needles partially through the loose mat (16), stripper (25), and bed plate (26) thereby causing the loose glass strands forming the mat to become entangled with one another.

Figure 4:
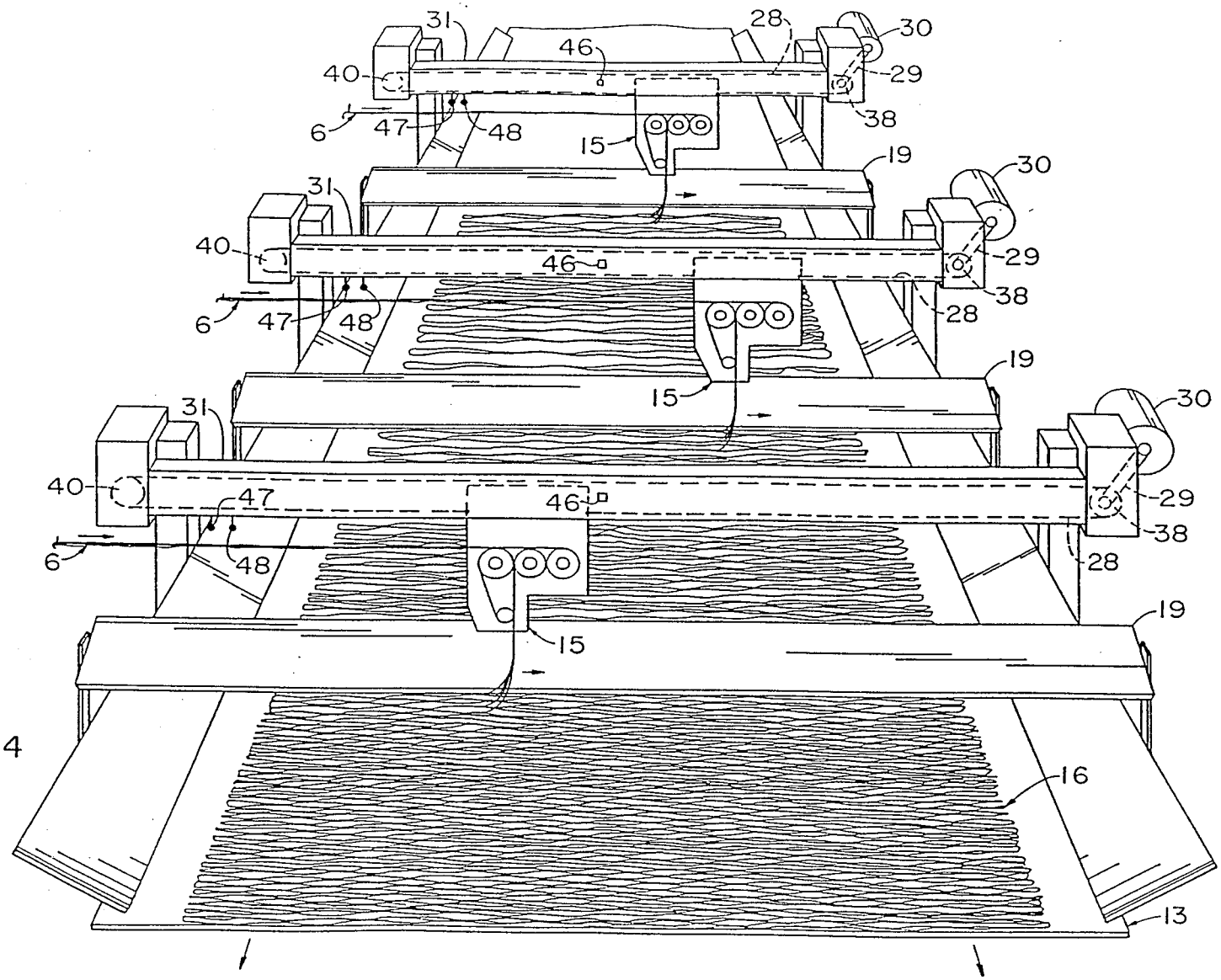
FIG. 4 is a perspective view of the front end of the mat line of FIG. 3 looking into Section 4—4 also showing, in detail, various components associated with the control of the reciprocating feeders.

Turning now to FIG. 4, individual strands (6) are guided through a plurality of ceramic eyelets (not shown) and passed to each feeder apparatus (15) where they are projected downwardly and deposited onto the surface of the moving chain conveyor (13). A plurality of strands may be provided to each individual feeder (15). (The exact number will depend on the speed of the conveyor (13), number of feeders in operation, and the desired density or thickness of the finished mat.) In the preferred embodiment of the instant invention, adjustable stationary deflectors (19), discussed previously, are positioned above the conveyor in such a manner that strands projected from each feeder impinge upon their surface and then fall toward the moving conveyor, whereupon they assume a random orientation.

Figure 5:
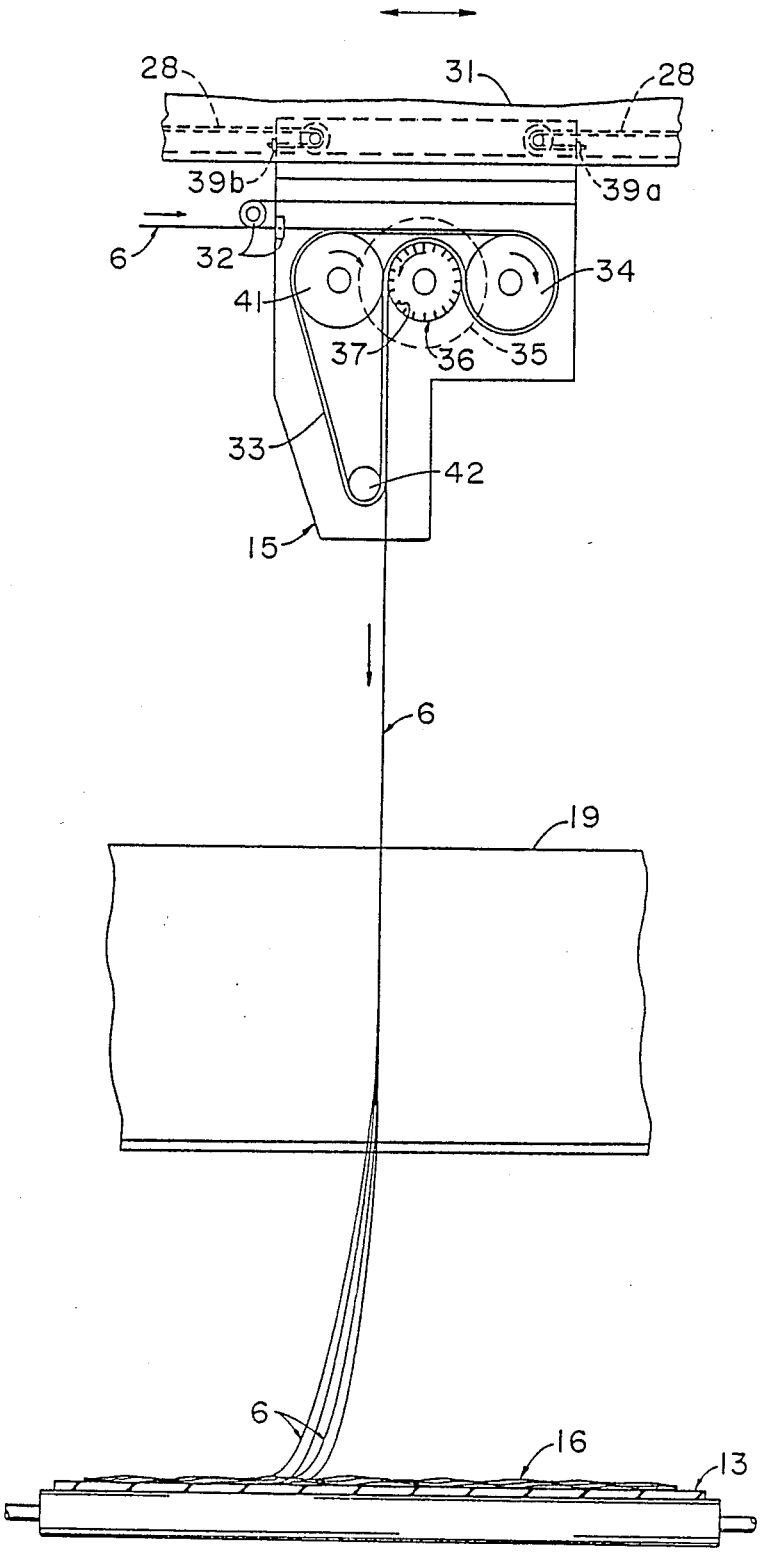
FIG. 5 is an elevational view of a reciprocating feeder, stationary deflector, and strand being deposited onto a moving conveyor.

The feeders (15) are caused to reciprocate or traverse back and forth across the width of the conveyor (13) by means of a flexible drive chain or cable (28). A second flexible drive belt or chain (29) connects the output shaft of a brushless servomotor (30) with a first rotatable pulley or drum (38), about the circumference of which is wrapped the flexible drive chain or, preferably, a stranded steel cable (28). The cable is of a length substantially twice the width of the conveyor. One end of the cable is firmly attached, as shown in FIG. 5, to one side of the feeder frame (39*a*). The cable is then wrapped once or twice around the circumference of the driven drum (38), brought across the width of the conveyor and over a second free-turning idler drum (40) where the opposite end of the cable is attached to the other side of the feeder frame (39*b*). Thus, as the driven drum (38), shown in FIG. 4, is rotated clockwise by means of the brushless servomotor (30), the feeder will advance to the left. When the servomotor reverses its direction and turns the drum (38) counter-clockwise, the feeder will advance towards the right. Each feeder (15) rides within a track (31) as it reciprocates across the moving conveyor (13). Typically, the velocity of the feeder as it reciprocates across the conveyor is between 75 and 200 fpm. The feeder traverses a direction generally perpendicular to the motion of the conveyor surface (13). The pay-out rate of strand (6) from each feeder (15) is typically within the range of about 1000 to 5000 fpm.

Turning to FIG. 5, a detailed view of the strand feeder (15) is illustrated. Strand (6), provided from either previously made forming packages or a fiber glass bushing assembly (1), is guided by a plurality of ceramic eyelets (32) so as to pass along the outside surface of a flexible belt (33). The belt (33) and strand (6) are passed around a free-turning cylindrical hub (34) mounted on a ball bearing (not shown). Upper (41) and lower (42) idler rollers are also provided. The strand (6) passes around the outside surface of the belt (33). The belt is caused to advance by friction between its inside surface and a cylindrical cage (36) which is driven by a variable-speed electric servomotor (35). The cage (36) has a plurality of pins or bars (37) protruding from its surface which run parallel along its length. The strand (6) contacts these bars and is pinched between them and the outer surface of the belt (33). This produces the tractive force necessary to advance the strand (6) from the individual forming packages (9) or bushing assembly (1).

DETAILED DESCRIPTION OF THE INVENTION

In the instant invention, an improved method for uniformly distributing strand on the surface of a moving conveyor using a programmable motion controller (43) is disclosed. The programmable motion controller is used to reciprocate each strand feeder (15) back and forth across the width of the conveyor (13) according to a pre-programmed velocity and position profile. The rate at which strand is deposited from each reciprocating feeder can also be simultaneously and independently controlled by the same programmable motion controller.

Motion controllers can be categorized as either chip or board-level devices. In chip-level devices, a single microprocessor or integrated circuit is used as the primary source of motion control. Integrated circuits developed over the past few years now contain several features optimized for motion control. These include special timers, counters, oscillators, and amplifiers to generate pulse-width-modulated (PWM) wave forms which can be used to drive electric motors. Specialized integrated circuits can also implement closed-loop feedback for motor-speed control.

Figure 6:
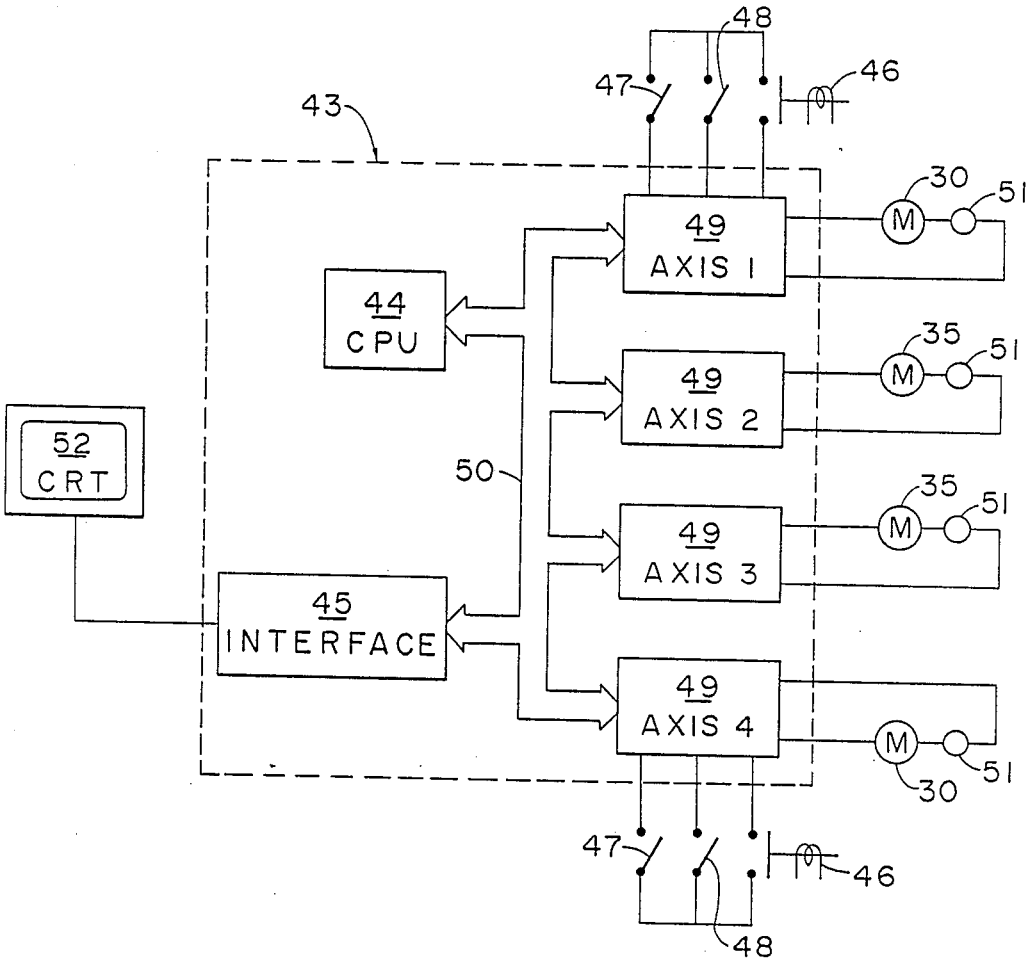
FIG. 6 illustrates, in block diagram form, the electrical circuit used to control the motion of each reciprocating feeder and the rate at which strand is deposited onto the conveyor.

Board-level motion controllers, such as illustrated in FIG. 6, typically contain several printed circuit boards having one or more of the above-described integrated circuits. As shown in FIG. 6, the boards are usually mounted inside an expandable rack chassis cabinet. One board (44) generally contains a computer or central processing unit (CPU) and its associated memory circuits while another board (45) typically contains the interface hardware necessary for connecting mass storage devices such as a hard disc drive or other peripherals such as a CRT terminal (52). A number of individual axis control boards (49) may be used to generate and amplify PWM wave forms to control separate electric motors. The computer may be programmed to start, stop and position several electric motors according to a pre-defined position, velocity, and acceleration rates. The individual boards communicate with one another and the OPU through the use of a standard digital communications bus (50). (A bus is a circuit that uses a single digital format to permit communication between several boards and the CPU.)

A number of commercially available board-level devices are available specifically for motion control. In the preferred embodiment of the instant invention, Model 3220 Flexible Automation Controller manufactured by Gould Electronics, available from MODICON Motion-ICC, Pittsburgh, Penna. was used. This particular controller can independently control the motion of up to 8 individual motors simultaneously according to pre-programmed positioning commands. It can also monitor both internal and external fault conditions such as a stalled motor, over-travel of the feeder or individual board malfunctions.

Tables containing different velocity profile information or positioning commands may be entered through a CRT terminal (52) and stored in the computer memory portion of the controller (43). An operator may then select the appropriate table for making a particular type of mat product and the CPU will download the selected profile into the system memory. Profiles may be entered in the form of a series of up to 500 or more individual data points. In the instant invention, each data point is used to define a sequence of locations or positioning commands along the width of the conveyor (13) which will be traversed by each feeder (15) within a fixed time interval. The profiling software in the controller fits a smooth curve to the data by a method known as cubic spline interpolation. The use of the cubic spline method, as opposed to linear interpolation, permits the calculation of continuous first and second derivatives to represent the velocity and acceleration profiles which correspond to the positioning commands entered previously. This capability also permits the feeders to be traversed with a velocity profile that results in the attenuation of substantially constant diameter fibers when a bushing assembly is used directly as the supply source of strand. Thus, the mechanical attenuator disclosed in U.S. Pat. No. 4,158,557 (Drummond) may be simulated electronically using the capabilities of the programmable motion controller.

The determination of the actual velocity profile to be used in the production of a particular mat product must be developed empirically by trial and error based upon the particular components and parameters used in the actual mat-making process. Factors such as the type of electric motors, chain speed of the conveyor, type of strand, and the mass and inertia of the feeder apparatus must all be considered. No general rule exists that can predict in advance what the net effect of any particular combination of components may be.

As was mentioned previously, non-uniformity in mat thickness has occurred predominantly near the edges of the mat. This buildup in strand density is due to the fact that the strand feeders are locally resident near the edges of the mat for a greater period of time during their reversal stroke than they are anywhere else. As long as strand is continuously deposited from the feeders at a constant rate, then it can do nothing but tend to accumulate more at the edges of the mat than the interior. In one attempt to overcome this problem, variable-speed A.C. induction motors coupled to frequency inverters to control the rate at which strand was deposited from the feeders were used as disclosed in U.S. patent application Ser. No. 07/418,058 (Bailey, et al.) There, the speed of the feeder motors (35) was lowered by the use of proximity sensors to detect the position of the feeder as it approached edge of the mat. For reasons which will be subsequently discussed, in the instant invention, the rate of the feeder motors (35) actually had to be increased, rather than decreased, near the mat edges in order to deposit a uniform density of strand. This was because of the rapid acceleration and deceleration characteristics of the electric servomotors (30) which were used to cause the feeders (15) to traverse back and forth across the conveyor.

Unlike conventional motors, servomotors are designed to have an extremely low rotor inertia. This provides them with relatively high torque to inertia ratios and permits rapid response times. In the preferred embodiment of the instant invention, the servomotors (30) used to reciprocate the feeders (15) were manufactured by the Getty Corporation and had a maximum stall torque of 106 in-lb., rotor inertia of 0.032 in-lbs-sec$^2$, and weighed approximately 47 lbs. The feeders themselves weighed about 100 lbs. and were decelerated from a maximum traverse velocity of about 160 fpm to zero in about 0.3 seconds. Because of the rapid reversal made possible using these particular servomotors, the inertia of the strand being deposited from the feeders produced mat edges that were actually thinner than those which had been seen in the past. Thus, the feed rate of strand had to be increased at each end of the reciprocation stroke. The reason for this can best be explained by considering the feeder illustrated in FIG. 5.

As the feeder (15) is advanced to the right and then reversed to travel in the opposite direction, the inertia of the strand (6) tends to keep it moving toward the right in a kind of swaying motion. The strand momentarily loses contact with the driven belt (33) and breaks around the driven cage (36). This causes the strand to sway toward the right-hand edge of the conveyor surface until it loses its linear momentum and tries to re-establish contact with the belt. By this time, the feeder (15) is already being accelerated toward the left-hand side of the conveyor and so the strand can only establish partial contact with the belt somewhere between the driven cage (36) and the lower idler (42). When the feeder reaches its left-most traverse position and is reversed, the inertia of the moving strand pushes it momentarily against the full surface of the moving belt (33). The strand breaks around the lower idler roller (42) and sways toward the left edge of the conveyor as the feeder begins moving toward the right. This time, however, the strand is actually pushed into contact with the full surface of the belt until the feeder reverses direction again and contact is lost. Because of this swaying effect of the strand, and the point on the belt which contact is lost and re-established, the strand actually sways a greater distance toward the right-hand side of the conveyor than the left. If the rate at which the strand was deposited from the feeders remained constant during the entire reversal cycle, the resulting mat would have edges that were actually thinner than the rest of the mat. To achieve a uniform strand density across the mat, the feed rate of the strand must be increased to allow more strand to be deposited at the edges of the mat and thus compensate for the effect of the sway. In fact, in one application where strand was deposited at a nominal feed rate of 1290 fpm, at the right-most portion of the traverse stroke where the strand momentarily lost contact with the belt (33), the feed rate had to be increased by approximately 7 percent while at the left-most portion of the traverse stroke, only a 3 percent increase in the feed rate was necessary.

The exact degree of compensation, as mentioned previously, must be determined empirically because of the number of variables which must be taken into account. The use of the programmable motion controller easily allows the evaluation of several combinations of acceleration, deceleration, and feed rates to be tried and optimized. Once the best combination has been achieved, these optimized position and velocity profiles can be stored in the controller memory.

Because of their low rotor inertia, high torque and superior response time, electric servomotors were also used in the feeders (15) to advance strand from the supply source onto the conveyor. In the preferred embodiment of the instant invention, each feeder was equipped with a servomotor manufactured by the Pacific Science Corporation. These motors had a stall torque of about 33 in-lbs, a rotor inertia of about 0.0019 in-lbs-sec$^2$, and weighed about 16 lbs. Since the speed of these servomotors is also capable of being incrementally controlled by the programmable motion controller according to a pre-programmed position profile, the need for proximity sensors and frequency inverters as taught by the prior art is eliminated. Control of the feed rate is also improved since it can be varied as an essentially continuous function of position across the width of the conveyor. To do this using the present state of the art, as disclosed in U.S. patent application Ser. No. 07/418,058 (Bailey, et al.), would require an almost infinite array of proximity sensors. The motion controller used herein permits changes in the location at which the feed rates are varied to be easily defined and input via the computer whereas, in the prior art, a change in the location at which to alter the feed rate would require the physical relocation of the proximity sensors attached to the track (31).

Another advantage of using programmably controlled servomotors in the instant invention is that they can be controlled and positioned more accurately than motors which have been used in the past. In the prior art systems which employed the use of stepping motors to reciprocate the feeders, the linear advance of the feeder (15) across the track (31) was controlled by generating an appropriate number of electrical pulses. Position feedback is generally not required in such a system. One of the disadvantages with using this approach is that in many situations, slippage, distortion, and other factors may prevent the stepper motors from moving accurately and precisely to their desired locations. To overcome this problem, the instant invention uses closed-loop feedback control well understood by those skilled in the art to provide precise positioning control information through the use of position sensing devices. The use of closed-loop feedback tends to minimize the difference or error between the desired position of the feeder and its actual location at any point in time. In the preferred embodiment of the instant invention, resolvers (51) were coupled to the output shaft of each traverse servomotor (30) and the shaft of each servomotor (35) used to advance strand through the feeders. The resolver generates an electrical signal proportional to the degree of rotation of each servomotor. This signal is then fed back to the programmable motion controller (43) and commands are generated by the computer to update the position of the feeder as well as the rate at which strand is deposited from the feeders onto the conveyor.

Figure 7:
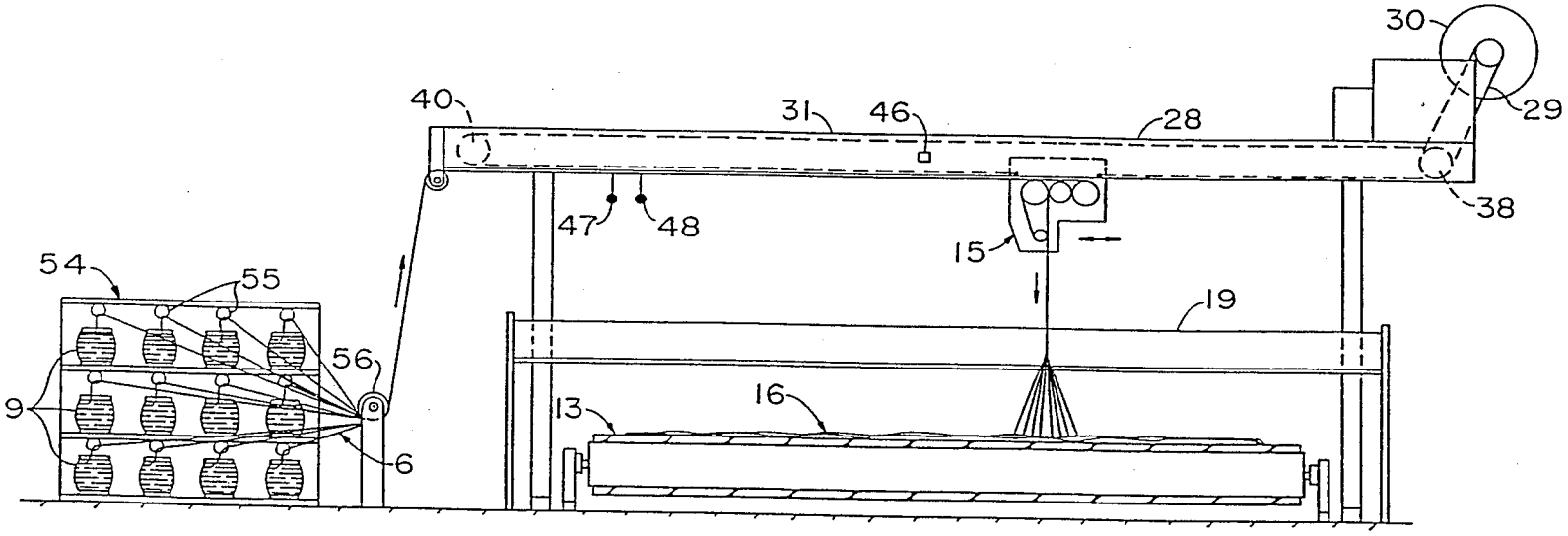
FIG. 7 is a front elevational view of a typical mat line taken along Section 7—7 of FIG. 3 further illustrating the orientation of the components associated with each reciprocating feeder.

In order to insure the proper startup and sequencing of the feeders when many are used simultaneously with one another, a limit switch (47) located on one side of the track (31), as shown in FIGS. 4, 6 and 7, is provided for each feeder. The purpose of the this limit switch (47) is to indicate a home position for the feeders (15) by sending a signal to the programmable motion controller (43). Once the controller senses that the feeders (15) are in their home position as indicated by the status of each home limit switch (47), the controller (43) jogs each feeder into an appropriate starting position. As each feeder comes into position to begin automatically traversing the conveyor, it will contact a second limit switch (48) whereupon a signal will be sent to the controller indicating that the feeder is in the start position. Once a start signal is received from each feeder, the controller (43) will issue a command at the appropriate time to cause each feeder to begin traversing the width of the conveyor.

Also located above the conveyor on each feeder track (31) and midway across the width of the conveyor surface, is an electromagnetic proximity switch or sensor (46). Each time the feeder (15) passes the proximity sensor causing it to close, a signal is transmitted to the motion controller (43), which is interpreted as meaning that the feeder has completed one-half of a traverse cycle. In commercial applications where many feeders have been used simultaneously to work in harmony with one another, the controller (43) can be programmed to recognize a pre-set sequence of signals from the centerline sensors associated with each individual feeder. Should the signal sequence detected by the motion controller (43) not be in agreement with the preprogrammed one, then the controller will interpret this as a malfunction in one of the feeders (15) and take corrective action. For example, if the controller were preprogrammed to expect a certain sequence of cross-over signals from feeders 1, 3 and 2 (in that order), and instead it only acknowledged the receipt of a signal from feeders 1 and 2, then the motion controller (43) would recognize that the receipt of a cross-over signal from feeder 2, when one was expected from feeder 3 instead, meant that a potential problem may exist, such as a stalled motor or jammed feeder which caused the sequence to be different than the one expected. The motion controller would then signal the startup of an extra feeder located at a position further down line in order to make up for the amount of strand not deposited on the conveyor due to the failure of the third feeder. In commercial applications, up to 12 active feeders have been used simultaneously with as many as 4 additional make-up feeders.

The use of the instant invention in the production of two different types of glass fiber mats will now be illustrated in detail.

EXAMPLE 1

In one application of the instant invention to produce a prototype continuous strand, needled fiber glass mat having uniform mechanical properties, two programmably controlled feeders (15) were reciprocated across the surface of a moving conveyor as illustrated in FIG. 7. Forming packages (9) of strand were held by means of a creel (54). Multiple strands (6) were passed through ceramic eyelet guides (55) on the creel and then through a guide bar (56). The strands (6) were then passed to two strand feeders (15). Stationary deflectors (19), previously described, were also employed to deflect the strand as it was ejected from each feeder. The conveyor surface moved continuously at a speed of about 4.8 fpm. An oven (17) heated to about 120° F. was also used to evaporate any excess moisture from the strands. Mat exiting the oven was then pulled through a needling loom (18) at a speed of about 4.9 fpm. The individual strands were then needled together in order to entangle them and impart sufficient mechanical integrity to allow the subsequent processing and handling of the finished mat. The needle loom (18) had a lineal needle density of about 40 needles per inch. The needles were reciprocated to yield a penetration density of about 140 penetrations per square inch. The penetration depth was about 0.6 inches.

The two feeders were reciprocated once every 2.93 seconds back and forth over a traverse distance of about 48 inches at an average velocity of about 82 fpm. The feeders were decelerated by the programmable motion controller from 105 fpm to zero in about 0.3 seconds and then accelerated back to 105 fpm in about 0.15 seconds. The servomotor (35) carried by each feeder (15) advanced the continuous strand supplied from the forming packages at a rate somewhere between 1280 and 1300 fpm, preferably about 1290 fpm. To compensate for the swaying effect of the strand mentioned previously, the feed rate was increased by 3 percent to about 1329 fpm at the left portion of the reciprocation stroke. At the right-most portion, the feed rate was increased by 7 percent to about 1380 fpm.

In the needled strand mat which was produced, randomly deposited strands of "T" fibers which were supplied from T-11.5 forming packages having about 400 individual glass fibers per strand with one pound containing about 1150 yards of strand. (The use of this alphabetical designation is well known in the art and here, the "T" fiber designation indicates that each individual glass fiber has a diameter on the order of 90 to 95 microns. (See Lowenstein, supra at page 25.) In order to produce a mat having a density of about 2.95 oz/sq-ft., 6 ends of T-11.5 strand were provided to each feeder so that about 135 lb/hr of glass was deposited onto the surface of the conveyor. In order to produce a mat having a density of about 2 oz/sq-ft., 4 ends of strand were provided so that only 90 lb/hr was deposited on the conveyor from each feeder.

EXAMPLE 2

It has been found desirable for some applications to produce a mat having anisotropic or uni-directional material properties. A mat having directionally-dependent mechanical properties, such as tensile strength, may be used to subsequently reinforce laminates which are used in the production of tire rims, automotive bumpers, or any structure in which it is desired that one direction have an enhanced tensile strength.

In the production of a prototype mat having directionally-dependent mechanical properties, several thousand individual filaments in the form of strand may be fed out onto a moving conveyor (13) and pulled along in the same direction of motion as the conveyor in such a manner so as to lie substantially parallel to one another.

Figure 8:
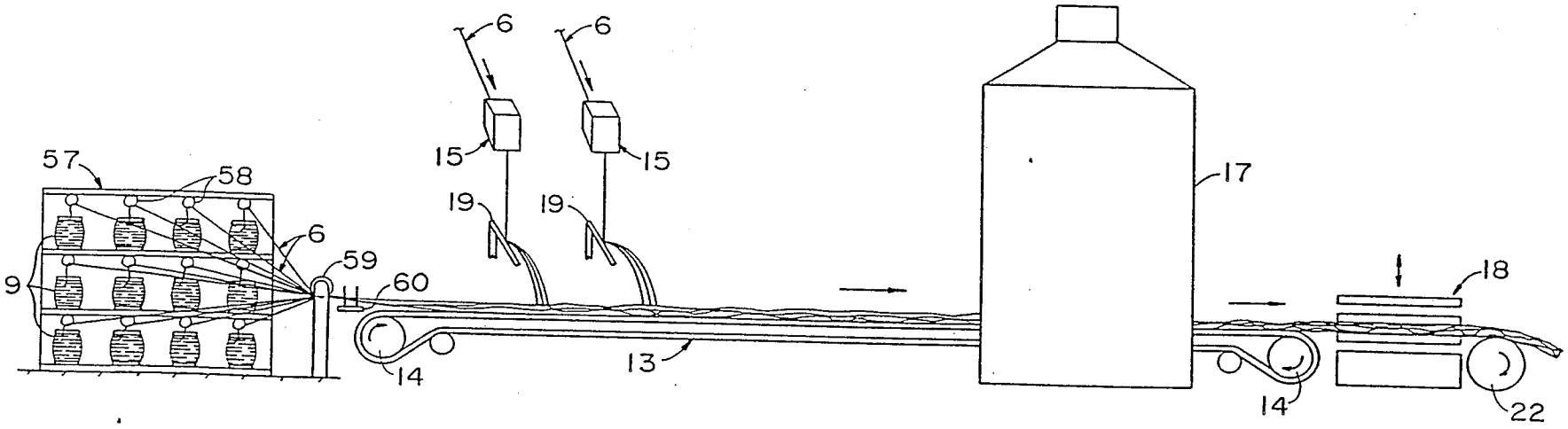
FIG. 8 is a side elevational view of a typical mat line configured to make a type of mat comprised of a top layer of randomly oriented strand needled to a lower layer uniformly aligned, parallel strand.

As shown in Figure 8, the strand (6) was supplied from roving packages held by a creel (57) located at the front of the conveyor. The strands (6) were passed through a plurality of ceramic eyelets (58) located on the creel (57) and then brought through an eyeboard (59) also located at the front of the conveyor (13). The strands were pulled through both the eyeboard and the tines of an accordion-like precision adjustable comb (60)

also located just in front of the conveyor. The comb was used to provide a uniform number of strands per inch across the width of the mat and can also be adjusted to provide different lineal strand densities depending upon the particular mat being made.

Additional strands (6) were supplied to each of two programmably-controlled reciprocating feeders (15) from individual forming packages as illustrated in FIG. 8. As these strands were advanced toward the surface of the conveyor (13) by the feeders (15), the weight of their build-up atop the first layer of strands, which were already moving in the direction of the conveyor, tends to hold and maintain them in a substantially parallel orientation. The strands projected by the reciprocating feeders (15) were also impinged upon the surface of a stationery deflector (19) just prior to their being deposited onto the conveyor. This resulted in a loosely bound mat having an upper layer of randomly oriented continuous strand and a bottom layer of substantially parallel strand. These loosely bound layers were then passed through an oven (17) similar to that described in Example 1 to remove any excess moisture. Mat exiting the oven was then pulled through a needling loom (18) where the upper and lower layers were being needled together in order to entangle the strands and impart sufficient mechanical integrity to them so as to allow the subsequent processing and handling of the finished mat.

The mat may have a content of anywhere from about 30 to 60 percent by weight of aligned parallel strand and anywhere from about 70 to 40 percent of randomly deposited continuous strand. In the preferred fiber glass strand mat which was produced, about 55 percent of the mat contained aligned parallel strand and the remaining 45 percent was randomly deposited by the programmable feeders (15) described herein. The parallel strand was supplied from direct-draw T-2.50 roving packages having about 1600 "T" fibers per strand. The precision adjustable comb (60) was set to provide anywhere from about 7.2 to 7.4 strands per inch across a 54 inch width of the conveyor surface. The randomly deposited strand was also a "T" fiber supplied from T-11.5 forming packages having about 400 fibers per strand with one pound containing about 1150 yards of strand. The conveyor surface moved at a uniform rate of about 5.8 fpm. Two feeders were reciprocated once every 3.15 seconds back and forth over a traverse distance of about 44 inches at a mean velocity of about 139 to 141 fpm. The servomotor (35) carried by each feeder advanced the continuous strand supplied from the forming packages at a rate somewhere between 1280 and 1300 fpm, preferably at about 1290 fpm. At the left-most portion of the traverse stroke, the feed rate of the strand was increased to 1329 fpm, while at the right-most end of the stroke the feed rate was increased to 1380 fpm. These feed rates were determined empirically to correct the problem of strand swaying discussed previously. The oven (17) was heated to about 120° F. and enclosed about a 20-foot length of the conveyor to evaporate excess moisture from the loosely formed mat. The mat was pulled through the needle loom (18) at a speed of about 6 ft/min. The needle loom (18) had a lineal needle density of about 40 needles per inch. The needles were reciprocated to yield a penetration density of about 140 penetrations per square inch to a depth of about 0.45 inches.

In order to produce a mat having a density of about 3.4 oz/sq-ft., 6 ends of T-11.5 strand were provided to each feeder so that about 135 lbs/hr of glass was deposited onto the surface of the conveyor from each feeder.

In using the programmable feeders to produce commercial quantities of needled fiber glass continuous strand mat, the instant invention may be modified slightly without departing from its spirit or scope. For example, between the time of their leaving the creel (54) and entering the feeder (15), the strands may be wet with water or some other liquid antistatic agent to reduce the buildup of static electricity. Typically, the strands should have between 5 and 15 percent moisture content by weight. This helps to reduce any tendency of the strand to break and wrap itself around the belt-driven feeders. Generally, the use of an antistatic agent such as Triton X-100 which is a nonionic octylphenoxy polyethoxy ethanol surfactant is recommended, especially when the strand is supplied from extremely dry forming packages which may have been stored for several months.

Also, as was disclosed in U.S. patent application Ser. No. 07/418,058 (Bailey, et al.), up to 12 reciprocating feeders may be used simultaneously with one another in order to produce commercial quantities of continuous fiber glass mat. The instant invention may be used to control the reciprocation and feed rates of each strand feeder.

Although all of the above examples have relied upon the needling of the strands in order to impart mechanical integrity to the loose mat structure, it is also a common practice well known in the art to deposit powdered resin particles onto the mat and then subsequently heat them in order to bond the strands and resin together rather than rely upon mechanical bonding produced by needling. In order to impregnate a continuous glass strand mat, it is usually sufficient to deposit the resin by sprinkling it directly upon the surface of the mat by means of a trough, and then agitate the mat by means well known in the art to disperse the particles inside the loose fiberous mat structure. The mat then enters an oven and is heated to a temperature sufficient to melt the resin. The mat and resin are then solidified by means of chill rollers, also well known in the art. The use of a resin such as ATLAC-300, manufactured by ICI-USA, Inc. is particularly well suited for this application. It is contemplated that the methods described above used to control the strand feeders may also be used to produce resin-bonded mats having similarly reduced density and thickness variations.

While the mats described in the above disclosure and the preceding examples have all been illustrated as being made from fiber glass strand, it is not intended that the application of the methods disclosed by this specification are necessarily limited thereto. For example, the same methods described herein may be used in the production of mats made from any other natural or synthetic fibers as well as glass. Strands composed of nylon, polyester, and the like, may also be substituted or mixed with one another as well as with packages carrying glass fibers.

Also, while the examples have illustrated the production of mats made from glass strand comprised of "T" fibers, it should be understood that the instant invention can be adapted to produce mat from strands comprised of any fiber diameter such as a "D"-type fiber or larger.

Furthermore, while the use of certain specific electrical components has been described, it is not intended that they be necessarily limiting since all are commercially available devices and other similar devices may be readily substituted to achieve substantially the same results. For example, the use of a resolver to accurately locate the position of the moving feeders also contemplates the use of devices such as encoders, synchros, light-emitting diodes, magnetic sensors, photo-electric sensors, electro-optical sensors, and mechanical limit switches. Furthermore, devices which produce substantially the same results as the board-level programmable motion controller described herein are also contemplated. For example, programmable logic controllers (PLC's) have become increasingly sophisticated in recent years and are no longer confined to the use of relay-ladder-type languages to emulate simple relay switching circuits. Many companies now produce PLC's that can accommodate up to 16,000 input/output (I/O) points as well as the ability to process analog I/O signals. Algorithms to perform proportional, integral, and differential control can also be implemented on advanced PLC's and special cards are available to perform servocontrol functions. Other cards, known as I/O scanners, are available to connect PLC's with personal computers so that high-level computer languages such as FORTRAN or BASIC may be used for programming the system.

Thus, while the instant invention has been described with respect to certain specific embodiments and components and illustrated with its application to the production of certain products, it is not intended to be so limited thereby; except, insofar as set forth in the accompanying claims.

I claim:

1. In a method for making a mat of continuous fiber strands by reciprocating at least one strand feeder back and forth across the surface of a moving conveyor, said strand feeder being caused to traverse the width of said conveyor by a first electric motor, said feeder also drawing at least one strand from a supply source and depositing it onto the surface of said conveyor by means of a second electric motor carried on said feeder, said supply source being a fiber glass bushing assembly issuing a plurality of individual streams of molten glass which are cooled and attenuated into individual glass fibers and subsequently gathered into at least one continuous strand of glass fibers, the improvement comprising: independently changing both the velocity profile with which said feeder is traversed across the width of said conveyor and the rate at which strand is attenuated, drawn, and advanced onto the surface of said conveyor as a function of the changing position of said strand feeder with respect to the width of said conveyor so as to attenuate individual fibers of substantially constant diameter and distribute the strand formed therefrom upon the surface of said conveyor, thereby forming a loose mate of glass fiber strand having substantially uniform thickness and density.

2. The method of claim 1 wherein said first electric motor used to cause said strand feeder to traverse back and forth is an electric servomotor.

3. The method of claim 2 wherein said second electric motor used to attenuate, draw, and advance strand from said supply source is an electric servomotor.

4. The method of claim 3 wherein the rate at which strand is drawn, advanced, and deposited from said feeder is incrementally changed at pre-determined locations across the width of said moving conveyor by a programmable motion controller so as to attenuate fibers of a substantially constant diameter from said supply source and uniformly deposit the strand formed therefrom upon the surface of said moving conveyor.

5. The method of claim 4 further comprising the improvement of: electronically monitoring the changing position of said strand feeder with respect to the width of said conveyor by a resolver coupled to the output shaft of said first electric servomotor used to reciprocate said strand feeder; electronically comparing the actual location of said strand feeder with a pre-programmed, expected location; and, correcting any discrepancy between the actual and expected locations by changing the traverse velocity of said strand feeder so as to correct its position with respect to the width of said conveyor.

6. The method of claim 4 further comprising the step of: needling said mat so as to entangle individual glass strands together with one another thereby forming a mat having improved uniformity of its mechanical properties and sufficient strength to withstand subsequent processing and handling.

7. The method of claim 5 further comprising the steps of: sprinkling a powdered resin into said mat; and, heating said mat and resin so as to cause said resin to melt and bond individual glass strands together with one another thereby forming a mat having improved uniformity of its mechanical properties and sufficient strength to withstand subsequent processing and handling.

8. In a method for making a mat of continuous fiber strands by reciprocating at least one strand feeder back and forth across the surface of a moving conveyor, said strand feeder being caused to traverse the width of said conveyor by a first electric motor, said feeder also drawing at least one strand from a supply source and depositing it onto the surface of said conveyor by means of a second electric motor carried on said feeder, the improvement comprising: independently changing both the velocity profile with which said feeder is traversed across the width of said conveyor and the rate at which strand is drawn and deposited onto the surface of said conveyor as a function of the changing position of said strand feeder with respect to the width of said conveyor so as to uniformly distribute strand thereon, thereby forming a loose mat of glass fiber strand having substantially uniform thickness and density.

9. The method of claim 8 wherein said first electric motor used to cause said strand feeder to traverse back and forth is an electric servomotor.

10. The method of claim 9 wherein said second electric motor used to draw and advance strand from said supply source is an electric servomotor.

11. The method of claim 10 wherein the rate at which strand is drawn, advanced, and deposited from said feeder is incrementally changed at pre-determined locations across the width of said moving conveyor by a programmable motion controller so as to uniformly deposit strand upon the surface of said moving conveyor.

12. The method of claim 11 further comprising the improvement of: electronically monitoring the changing position of said strand feeder with respect to the width of said conveyor by a resolver coupled to the output shaft of said first electric servomotor used to reciprocate said strand feeder; electronically comparing the actual location of said strand feeder with a pre-programmed, expected location; and, correcting any discrepancy between the actual and expected locations by changing the traverse velocity of said strand feeder so as to correct its position with respect to the width of said conveyor.

13. The method of claim 12 further comprising the step of: needling said mat so as to entangle individual glass strands together with one another thereby forming a mat having improved uniformity of its mechanical properties and sufficient strength to withstand subsequent processing and handling.

14. The method of claim 13 wherein said strands are strands of multiple glass fibers.

15. The method of claim 12 further comprising the steps of: sprinkling a powdered resin onto said mat; and, heating said mat and resin so as to cause said resin to melt and bond individual glass strands together with one another thereby forming a mat having improved uniformity of its mechanical properties and sufficient strength to withstand subsequent processing and handling.

16. The method of claim 15 wherein said strands are strands of multiple glass fibers.

17. In a method for making a layered mat of continuous fiber strands by passing a first layer of strands from a first supply source onto the surface of a moving conveyor, pulling said strands along in the same direction of motion as said conveyor so as to align the individual strands substantially parallel to one another, reciprocating at least one strand feeder back and forth across the surface of said conveyor and first layer of strand, said feeder being caused to traverse the width of said conveyor by a first electric motor, said feeder also drawing at least one strand from a second supply source and depositing it atop said first layer of aligned strands and conveyor by means of a second electric motor carried on said feeder, and subsequently needling both said first and second layers of strand together so as to entangle individual strands with one another thereby forming a mat having anisotropic mechanical properties, the improvement comprising: independently changing both the velocity profile with which said feeder is traversed across the width of said conveyor and the rate at which strand is drawn and deposited from said second supply source onto the surface of said conveyor and first layer of strand as a function of the changing position of said strand feeder with respect to the width of said conveyor so as to uniformly deposit strand thereon, thereby forming a mat having substantially uniform thickness and density.

18. The method of claim 17 wherein the rate at which strand is drawn, advanced, and deposited from said feeder is incrementally changed at pre-determined locations across the width of said moving conveyor by a programmable motion controller so as to uniformly deposit a second layer of strand atop said first layer of aligned strand and said moving conveyor.

19. The method of claim 18 further comprising the improvement of: electronically monitoring the changing position of said strand feeder with respect to the width of said conveyor by a resolver coupled to the output shaft of said first electric motor used to reciprocate said strand feeder; electronically comparing the actual location of said strand feeder with an expected pre-programmed location and, correcting any discrepancy between the actual and expected locations by changing the traverse velocity of said feeder so as to correct its position with respect to the width of said conveyor.

20. The method of claim 19 wherein said second supply source of strand is a fiber glass bushing issuing a plurality of individual streams of molten glass which are cooled and attenuated into individual glass fibers and subsequently gathered into at least one continuous strand of glass fibers.

21. The method of claim 20 wherein the rate at which strand is advanced and deposited from said feeder is further changed at pre-determined locations across the width of said moving conveyor by a programmable motion controller so as to attenuate fibers of a substantially constant diameter from said bushing assembly and uniformly deposit a second layer of strand atop said first layer of aligned strand and said moving conveyor.

* * * * *

UNITED STATES PATENT AND TRADEMARK OFFICE

CERTIFICATE OF CORRECTION

PATENT NO. : 4,964,891

DATED : October 23, 1990

INVENTOR(S) : William L. Schaefer

It is certified that error appears in the above-identified patent and that said Letters Patent is hereby corrected as shown below:

Column 16, line 16;
Claim 6, line 1, "4" should be --5--.

Column 15, line 55;
Claim 1, line 23, "mate" should be --mat--.

Signed and Sealed this

Thirty-first Day of March, 1992

*Attest:*

HARRY F. MANBECK, JR.

*Attesting Officer*

*Commissioner of Patents and Trademarks*